US007448095B1

(12) United States Patent
Agaeliaho

(10) Patent No.: US 7,448,095 B1
(45) Date of Patent: Nov. 11, 2008

(54) TIME TUB

(76) Inventor: Itshak T Agaeliaho, 257-10 Pembroke Ave., Great Neck, NY (US) 11020-1038

( * ) Notice: Subject to any disclaimer, the term of this patent is extended or adjusted under 35 U.S.C. 154(b) by 113 days.

(21) Appl. No.: 11/622,689

(22) Filed: Jan. 12, 2007

(51) Int. Cl.
*A47K 3/02* (2006.01)
*E04H 4/00* (2006.01)

(52) U.S. Cl. ..... 4/538; 4/493; 4/541.1; 4/545

(58) Field of Classification Search ..... 4/493, 4/538, 541.1–541.3, 545, 584
See application file for complete search history.

(56) References Cited

U.S. PATENT DOCUMENTS 3,614,792 A 10/1971 Sierant
4,010,498 A 3/1977 Jablonski
4,051,563 A 10/1977 Clarke, Jr.
4,868,934 A 9/1989 Altman
5,144,703 A 9/1992 Maire
5,839,132 A 11/1998 Rooney
5,932,127 A * 8/1999 Maddox ..... 4/493
6,085,367 A 7/2000 Guiste
6,336,231 B1 1/2002 Smith
6,747,367 B2 * 6/2004 Cline et al. ..... 4/493

FOREIGN PATENT DOCUMENTS

EP 0015335 9/1980
EP 0316274 5/1989

* cited by examiner

*Primary Examiner*—Tuan N Nguyen
(74) *Attorney, Agent, or Firm*—Michael I Kroll

(57) ABSTRACT

A tub having a water holding tank or jacket and a plurality of apertures in the tub so that water from the water jacket can be quickly transferred to the tub and controls within the system to provide means for the user to define water temperature, volume and rate of flow.

19 Claims, 15 Drawing Sheets

TIME TUB

BACKGROUND OF THE INVENTION

1. Field of the Invention

The present invention relates generally to bathtubs, bathtub liners or systems and, more specifically, to a tub having a water jacket.

The present invention is a tub having a water jacket and apertures within the tub so that the water from the water jacket can be moved quickly to the tub by depressing an actuator. The tub includes a temperature control means for varying the temperature of the water within the water jacket. The aforementioned water jacket is incorporated into the housing of a bath tub or jacuzzi.

The system of the present invention provides means for the user to define water temperature, volume, rate of flow, a timer module, a jacuzzi jet module and a user settings module for user defined preset of each of the features.

A touch pad/button control panel interfaces with a central processing unit to manage water disbursement valves, control sensors and a heating element. These main components are used to manage the water temperature, water volume, rate of flow, a timer module, and a jacuzzi jet module.

The aforementioned controls within the system provide means for the user to define and set water temperature. Additionally, the user may vary existing water temperature by selecting increase or decrease from preset temperature. These controls also provide means for the user to define and set water volume range of 25% to capacity. Additionally, the user may vary existing water volume by selecting increase or decrease from pre selected volume.

The system also provides means for the user to define and set flow rate ranging from maximum to 25% maximum rate. Additionally, the user may vary existing water flow rate by selecting increase or decrease from pre selected flow rate. The user can also define and set the time for the water to be dispersed from the water jacket to the tub. The user may define an elapsed time from a set point in time, or may define the water to be dispersed at a given real time (example: 8:00 am). Lastly, said controls provide means for the user to enable or disable jet propulsions of water, air, or a combination of water and air through the apertures within the tub.

2. Description of the Prior Art

There are other bathing systems and devices. Typical of these is U.S. Pat. No. 3,614,792 issued to Sierant on Oct. 26, 1971.

Another patent was issued to Jablonski on Mar. 8, 1977 as U.S. Pat. No. 4,010,498. Yet another U.S. Pat. No. 4,051,563 was issued to Clark, Jr. on Oct. 4, 1977 and still yet another was issued on Sep. 26, 1989 to Altman as U.S. Pat. No. 4,868,934. Another patent was issued to Maire on Sep. 8, 1992 as U.S. Pat. No. 5,144,703.

Yet another U.S. Pat. No. 5,839,132 was issued to Rooney on Nov. 24, 1998. Another was issued to Guiste on Jul. 11, 2000 as U.S. Pat. No. 6,085,367 and still yet another was issued on Jan. 8, 2002 to Smith as U.S. Pat. No. 6,336,231.

Internationally, a publication was issued to Lasaiandra on Sep. 17, 1980 as European Patent Application No. EP0015355 and still another European Patent Application was published on Nov. 2, 1988 to Mueller-Major as EP0316274.

U.S. Pat. No. 3,614,792

Inventor: Stanley Leslie Sierant

Issued: Oct. 26, 1971

A bathtub having water introducing hollow perforated means extending along the lower part of the tub adjacent the intersection of the bottom and side walls of the tub, the hollow perforated means directly a plurality of jets of water upwardly and inwardly into the tub. A headrest is provided at one end of the tub adjacent the bottom thereof.

U.S. Pat. No. 4,010,498

Inventor: Frank W. Jablonski

Issued: Mar. 8, 1977

A bathtub safety liner-spray apparatus that includes padding for comfort and safety and a multiplicity of spray heads that provide a shower effect within the bathtub's cavity.

U.S. Pat. No. 4,051,563

Inventor: Joseph A. Clarke, Jr.

Issued: Oct. 4, 1977

A cushioned liner that fits inside a bath tub has a back cushion provided by a flexible water bag conforming to the back of the tub and left and right side cushions provided by flexible bags conforming to the left and right sides of the tub, the bags being connected together end to end and across the bottom of the tub by a bottom portion that conforms to the tub bottom. The insides of the bags are interconnected and all are filled with water through a common filling hose after installing in the tub and before the tub is filled with water for bathing. When the tub is drained, the bags can be drained through one or more drain plugs and openings in the bottom of the liner are provided to permit draining.

U.S. Pat. No. 4,868,934

Inventor: Murray Altman

Issued: Sep. 26, 1989

An improved self-cleaning bathtub having a reservoir large enough for multiple usages and an improved unitary water diversion system is disclosed.

U.S. Pat. No. 5,144,703

Inventor: Laura M. Maire

Issued: Sep. 8, 1992

An apparatus for insertion within a bathtub defined by spaced parallel side walls, a floor coextensive with the side walls, and a rear wall mounting a cushion at an upper terminal end thereof directed orthogonally between the side walls. The side walls are pneumatically or fluidly filled within chambers formed in the side walls, wherein the floor includes a chamber for filling overlying a lower chamber filled with a granular material to effect stable positioning of the organization in use. Suction cup members are mounted coextensively along the floor, side walls, and cushion for securement to an interior surface of an associated bathtub.

U.S. Pat. No. 5,839,132

Inventor: Todd D. Rooney

Issued: Nov. 24, 1998

An improved disposable bathtub liner includes inflatable sub-compartrnents which detachably adhere to the interior surface of a bathtub through suction devices on the exterior surface of the liner. The bathtub liner includes opposite side-walls, endwalls, and at least a partial bottom, and is made of a material which is durable, economical and disposable, while at the same time provides frictional engagement with a person, and which can be detachably sealed to the interior of the interior surface of the bathtub.

U.S. Pat. No. 6,085,367

Inventor: Judith Guiste

Issued: Jul. 11, 2000

A unitary bathtub liner comprised of: a. a bottom section and four side sections that extend substantially to the top edge of the bathtub, the liner being capable of containing water; b. the liner being comprised of a thermoplastic polymer of sufficient thickness that it is flexible enough to generally conform to the bathtub; c. a device on the side of the liner that comes in contact with the bathtub for affixing the liner to the bathtub; and d. a drain that is located in the bottom of the liner in the relative location of a drain in the bathtub, said drain in the liner having a leak-resistant device for communicating with the drain in the bathtub.

U.S. Pat. No. 6,336,231

Inventor: Hermenie I. Smith

Issued: Jan. 8, 2002

An inflatable liner for use with conventional bathtubs is disclosed. For use with infants, elderly, physically disabled, or other instances where a cushioned and/or sanitary bathing surface is desired. A battery operated air pump is attached to the inflatable liner via small plastic tubes. The air pump is used to inflate the liner. The present invention also has an air trap valve to prevent over inflation. The inflatable liner is composed of separate air reservoir tubes that conform to the shape of the bathtub, surrounding the entire interior surface area of the bathtub. Once inflated, the actual tub itself provides the present invention with its shape and rigidity A convenient drainage hole with cover is incorporated into the inflatable liner, which allows the user to drain water out of the invention and bathtub before the present invention is removed from the tub and stored.

European Patent Application Number: EP0015355

Inventor: Raffaele Lasaiandra

Issued: Sep. 17, 1980

A folding water reservoir suitable for regions where there is water-shortage, consisting of a sack of thin plastic, shaped as the inner side of the bath-tub, and joined, so as to be easily replaced, to a covering plate made up of two plastic plates connected to each other along axis so as to be folded as a book after use. Covering plate rests on the rims of the bath-tub and is supplied with openings for the filling and drawing of water from the reservoir.

European Patent Application Number: EP0316274

Inventor: Mueller-Major

Issued: May 17, 1989

In order to prevent corrosion of the enamel-type bathtub lining due to the bath water and/or bath water additives, the bathtub is covered by a plastic covering which consists of material which is impermeable to water, resistant to swelling, shrinking and heat, and has the shape of the bathtub.

While these tub and bath liners and/or devices may be suitable for the purposes for which they were designed, they would not be as suitable for the purposes of the present invention, as hereinafter described.

SUMMARY OF THE PRESENT INVENTION

A primary object of the present invention is to provide a tub having a water jacket and apertures within the tub so that the water from the water jacket can be moved very fast to the tub.

Another object of the present invention is to provide a tub having a water jacket and apertures within the tub and controls for the user to define water temperature.

Yet another object of the present invention is to provide a tub having a water jacket and apertures within the tub and controls for the user to define water volume to be dispensed.

Another object of the present invention is to provide a tub having a water jacket and apertures within the tub and controls for the user to define flow rate of water to be dispensed.

Still yet another object of the present invention is to provide a tub having a water jacket and apertures within the tub and timer controls for the user to define when water is to be dispensed.

Another object of the present invention is to provide a tub having a water jacket and apertures within the tub and a touch pad/button control panel for the user to define desired settings.

Yet another object of the present invention is to provide a tub having a water jacket and apertures within the tub and controls for the user to define jacuzzi action of dispersed water, air or both.

Additional objects of the present invention will appear as the description proceeds.

The present invention overcomes the shortcomings of the prior art by providing a tub having a water holding tank or jacket and a plurality of apertures in the tub so that water from the water jacket can be quickly transferred to the tub and controls within the system to provide means for the user to define water temperature, volume and rate of flow.

The foregoing and other objectives and advantages will appear from the description to follow. In the description, reference is made to the accompanying drawings, which forms a part hereof, and in which is shown, by way of illustration, specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
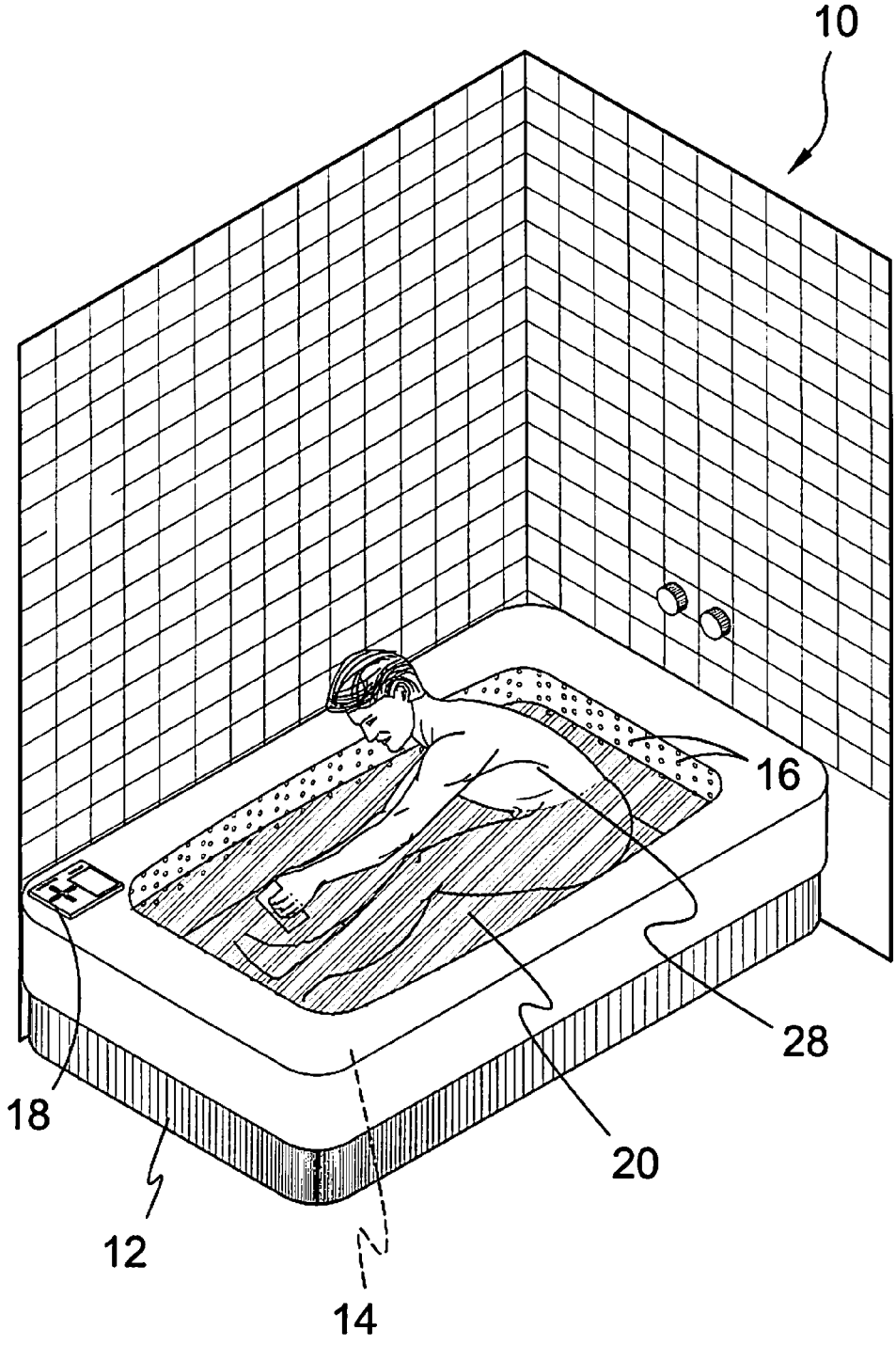
FIG. 1 is an illustrative view of the present invention in use.

Turning now descriptively to the drawings, in which similar reference characters denote similar elements throughout the several views, the figures illustrate the Method and Apparatus for a Timed, Self Filling Tub of the present invention. With regard to the reference numerals used, the following numbering is used throughout the various drawing figures.

10 Method and Apparatus for a Timed, Self Filling Tub of the present
12 bathtub
14 water jacket
16 water inlet apertures
18 control panel
20 pre-tempered water
22 drain
24 cold water feed
26 hot water feed
28 user
30 control buttons of 18
32 digital display
34 processor
36 water dispersal valve
38 water heating element
40 water intake valve
42 water control sensor
44 water temperature control module
46 water volume control module
48 water flow rate control module
50 timer module
52 spa jet control module
54 user settings module
56 thermostatic mixing valve
58 thermostat
60 electronic valve
62 mixed water feed

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. The present invention 10 is a method and apparatus for filling a tub 12 having a water jacket 14 encapsulating it on all sides and water inlet apertures 16 within the walls of the tub 12 so that the pre-tempered water 20 from the water jacket 14 can be transferred quickly to the tub 12 by depressing an actuator on the control panel 18. The tub 12 includes temperature control means for varying the temperature of the water 20 within the water jacket 14. The water jacket 14 incorporated into the housing of a bath tub 12 or jacuzzi.

Figure 2:
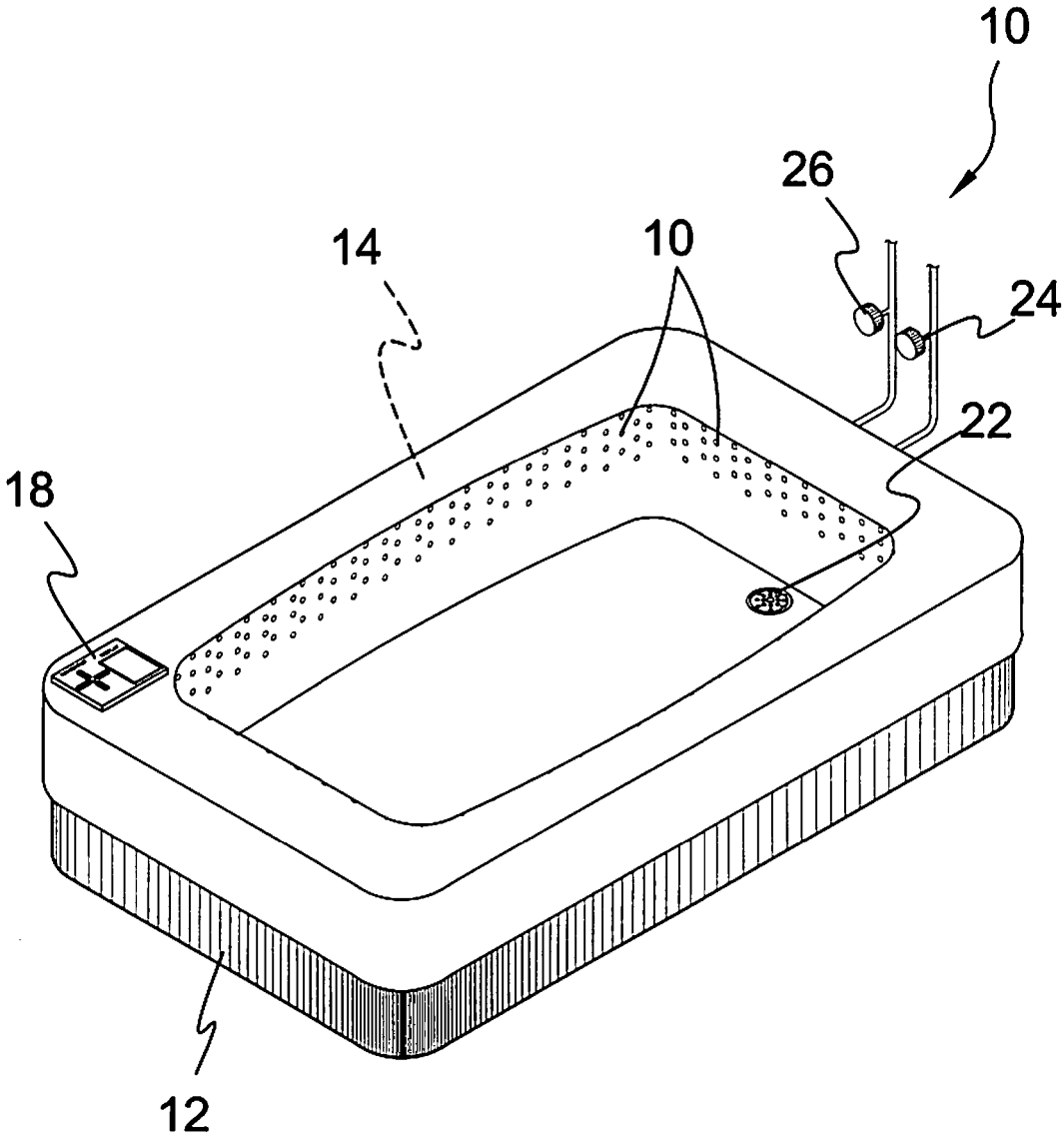
FIG. 2 is a perspective view of the present invention.

FIG. 2 is a perspective view of the present invention 10. The present invention 10 is a method and apparatus for rapidly filling a tub 12 with a predetermined amount of water heated to a pre-selected temperature after entering the water jacket 14 through the hot 26 and cold 24 water feeds. A conveniently placed control panel 18 provide means for the user to define water temperature, volume and rate of flow. The water is introduced into the tub interior through the apertures 16 and is removed therefrom through the drain 22.

Figure 3:
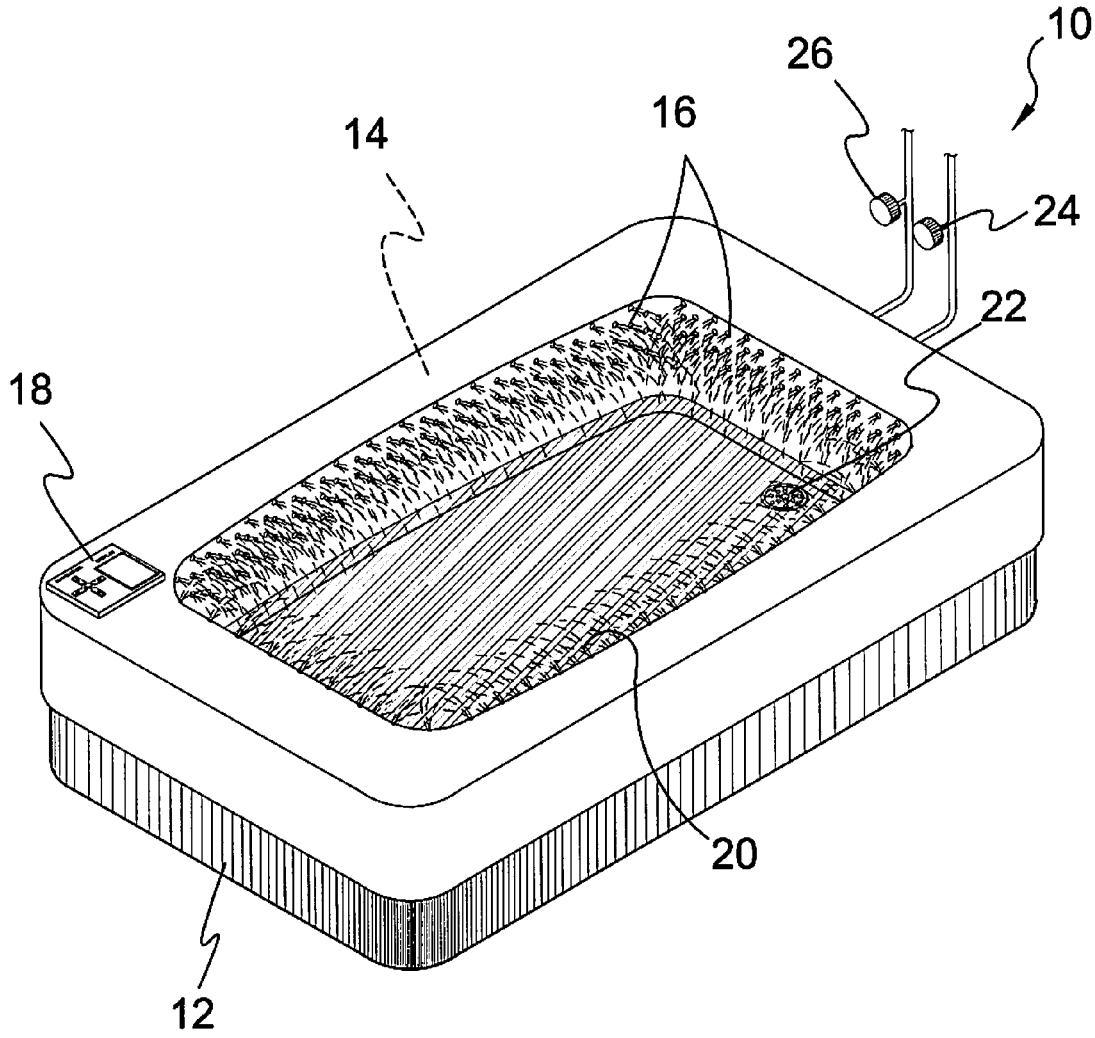
FIG. 3 is a perspective view of the present invention in use.

FIG. 3 is a perspective view of the present invention 10 in use. The present invention 10 is a method and apparatus for rapidly filling a tub 12 with a predetermined amount of water 20 heated to a pre-selected temperature after entering the water jacket 14 through the hot 26 and cold 24 water feeds. A conveniently placed control panel 18 provides means for the user to define water temperature, volume and rate of flow. The water 20 is introduced into the tub interior through the apertures 16 and is removed therefrom through the drain 22.

Figure 4:
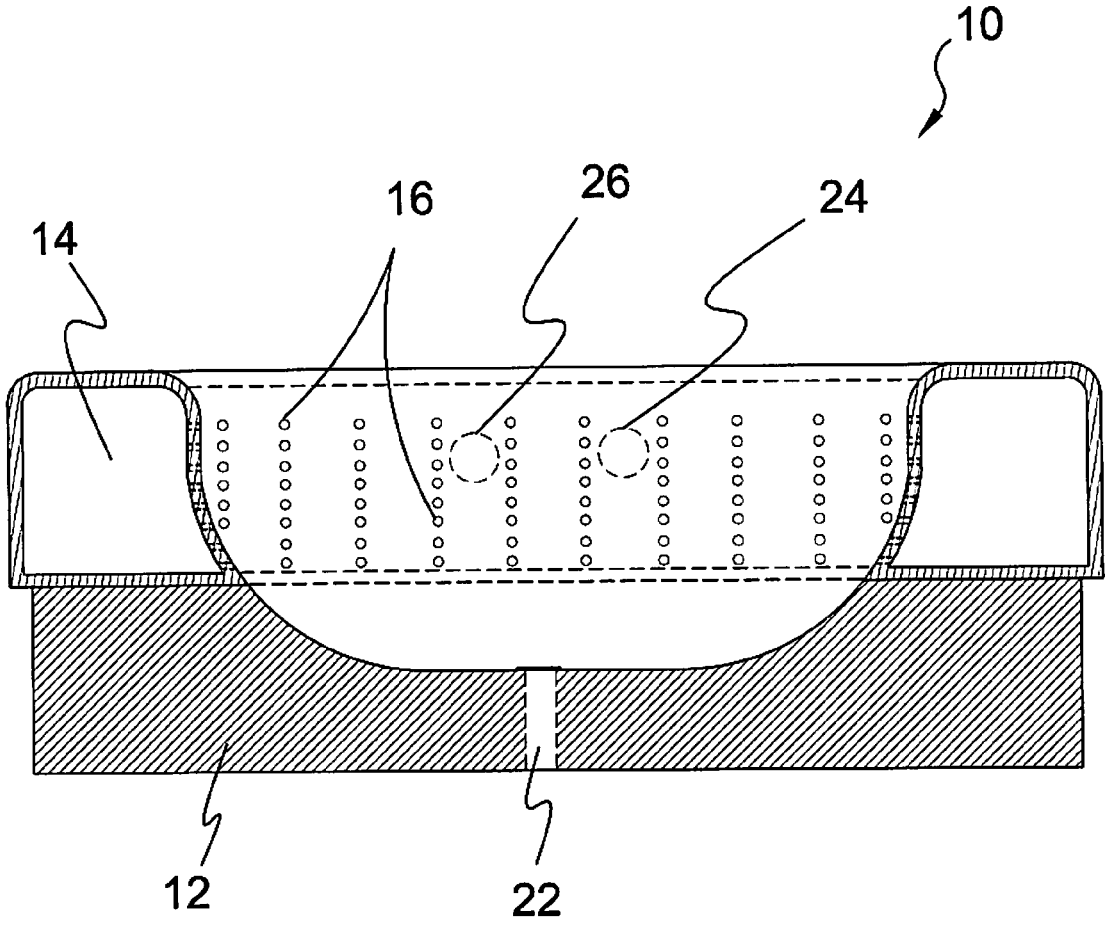
FIG. 4 is a sectional view of the present invention.

FIG. 4 is a sectional view of the present invention 10. Shown is a sectional view of the bathtub 12 wherein pre-tempered water is distributed to water jacket 14 from the cold 24 and hot 26 water feeds and retained therein until the user selected time and is then released into the tub 12 through the plurality of apertures 16. The water 20 is removed by opening the drain 22.

Figure 5:
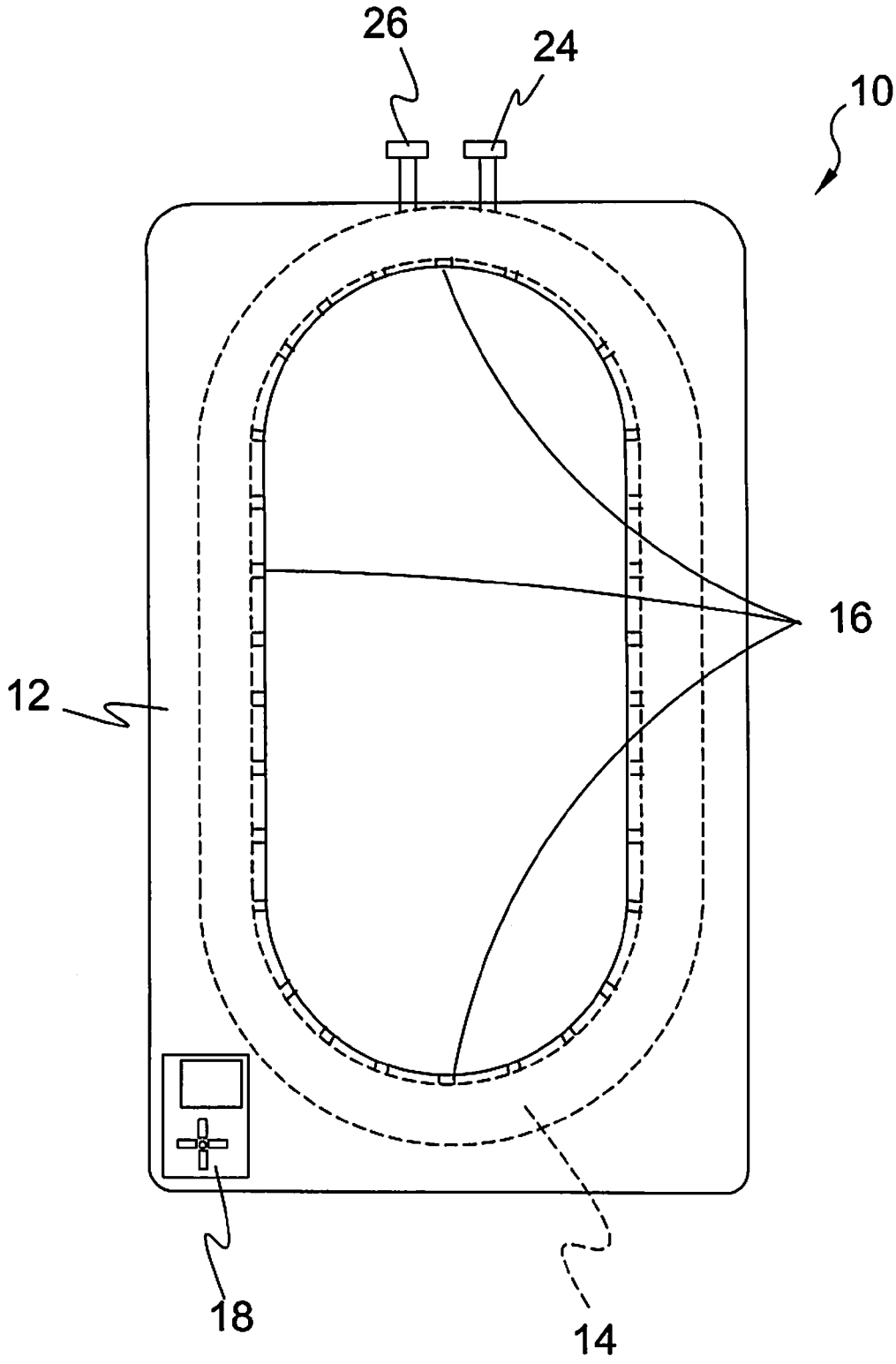
FIG. 5 is a top view of the present invention.

FIG. 5 is a top view of the present invention 10. Shown is a top view of the bathtub 12 wherein pre-tempered water is distributed to the water jacket 14 from the cold 24 and hot 26 water feeds and retained therein until the user selected time and is then released into the tub 12 through the plurality of apertures 16.

Figure 6:
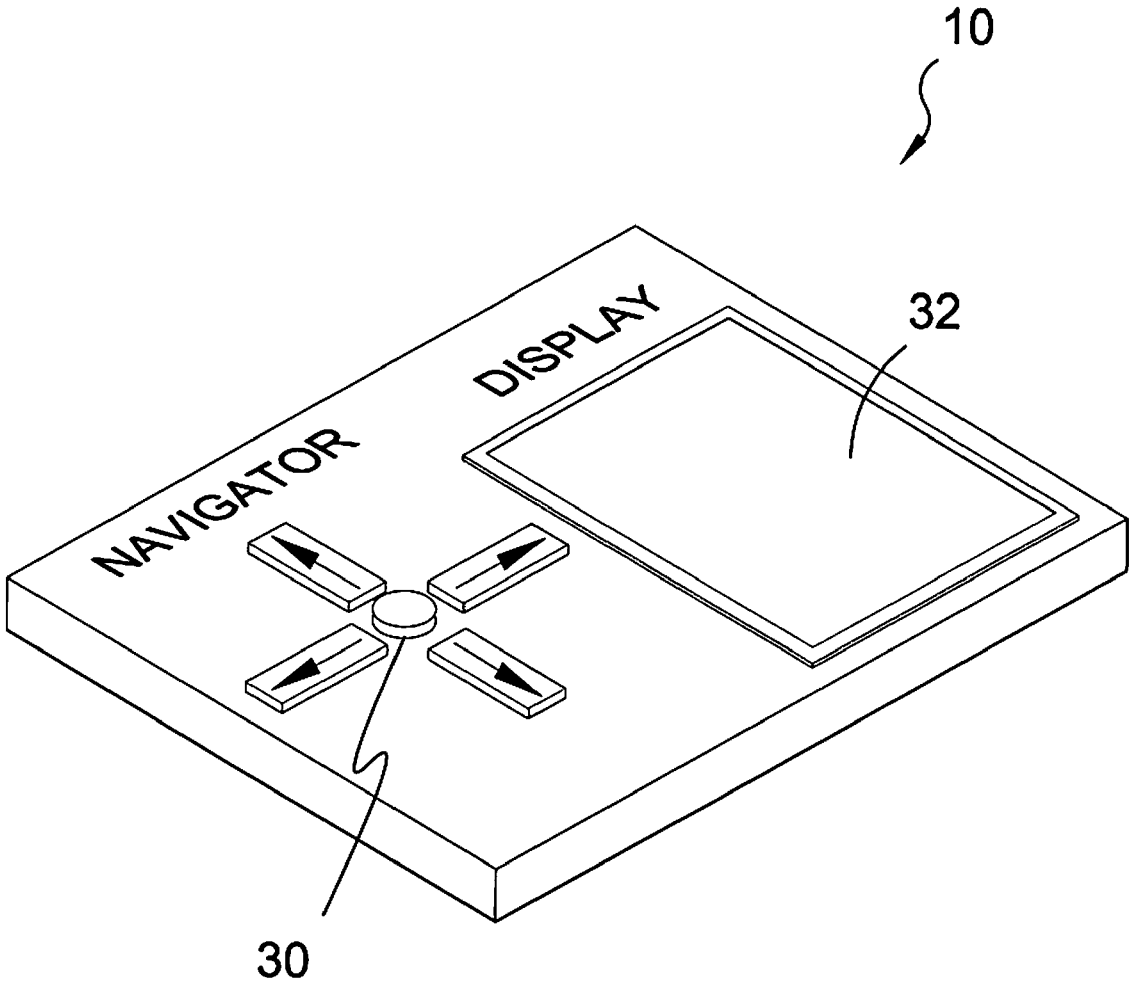
FIG. 6 is a detail perspective view of the control panel of the present invention.

FIG. 6 is a detail perspective view of the control panel 18 of the present invention 10. Shown is the control panel of the present invention, a tub having a water jacket and a plurality of apertures in the tub so that water from the water jacket can be quickly transferred to the tub. Controls within the system provide means for the user to define water temperature, volume and rate of flow, a timer module and user settings for use to define preset of each feature.

Figure 7:
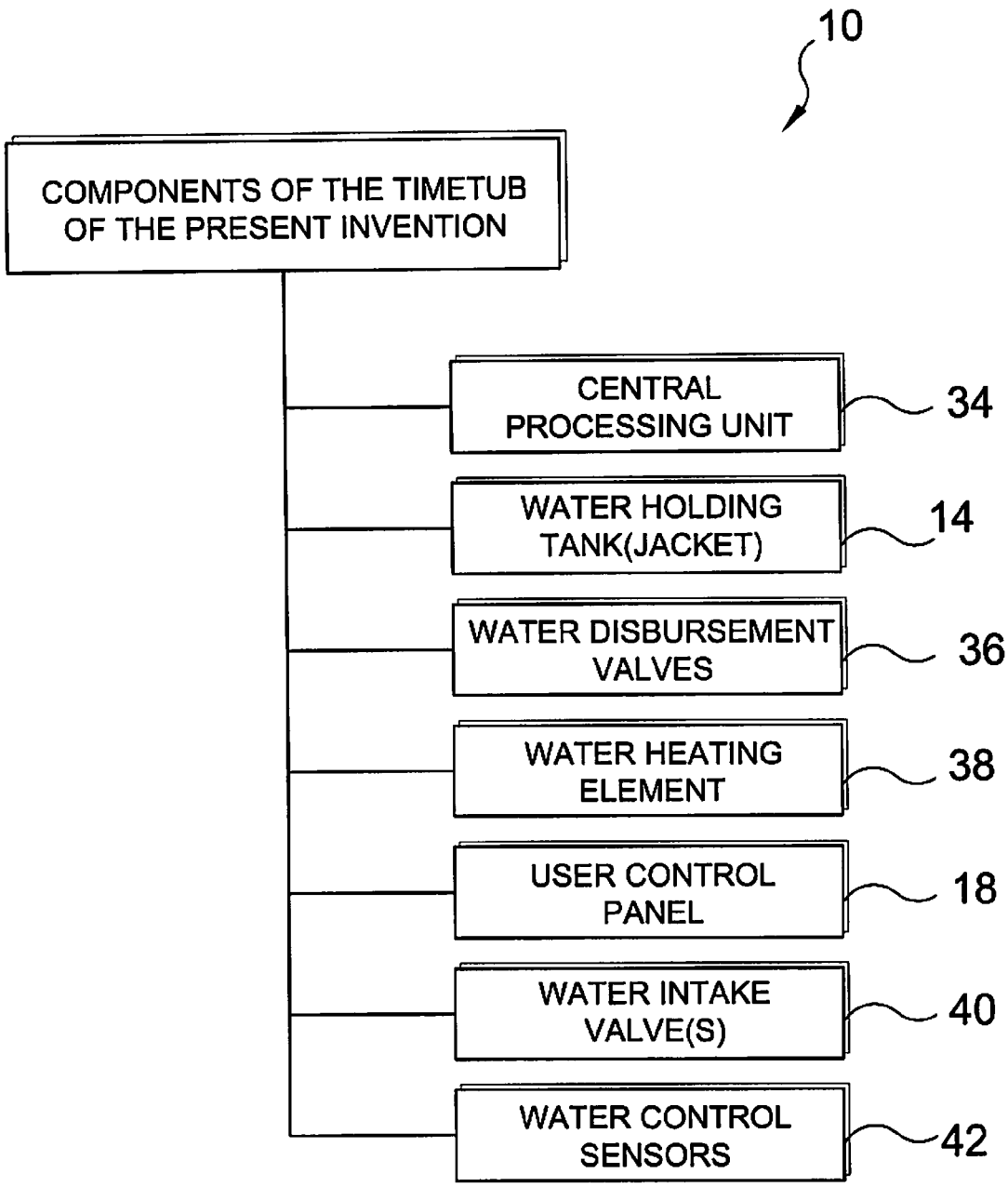
FIG. 7 is a block diagram of the present invention's main components.

FIG. 7 is a block diagram of the present invention's 10 main components. The user control panel 18 communicates with the central processing unit 34 to enable the user to control water temperature and distribution through disbursement valves 36, a water heating element 38, water intake valves 40 and water control sensors 42.

Figure 8:
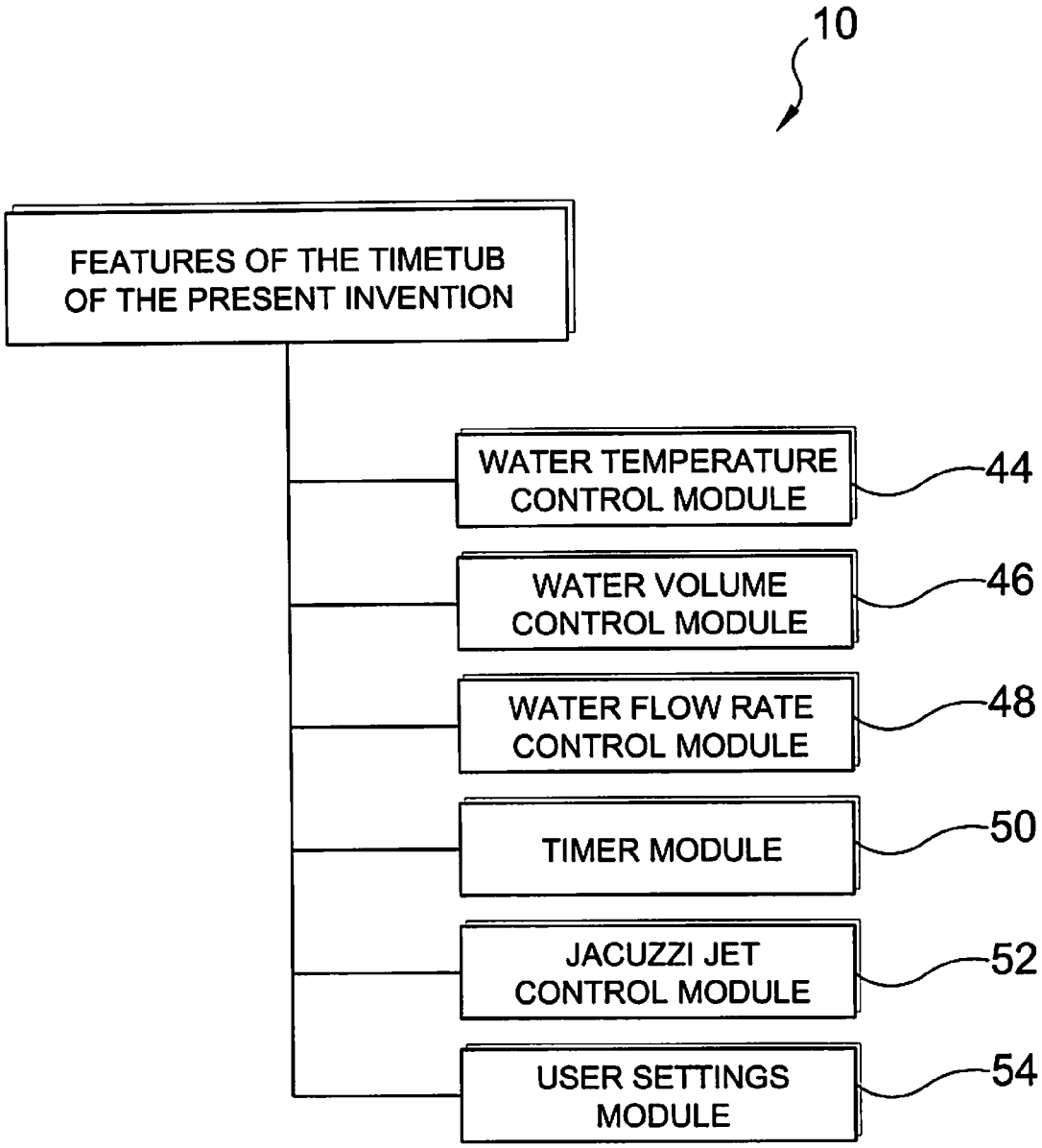
FIG. 8 is a block diagram of the present invention's main features.

FIG. 8 is a block diagram of the present invention's main features. Controls within the system provide means for the user to define water temperature and distribution though a temperature control module 44, volume control module 46, rate of flow control module 48, a timer module 50, jacuzzi jet module 52 and a user settings module 54 for user defined preset of each of the features.

Figure 9:
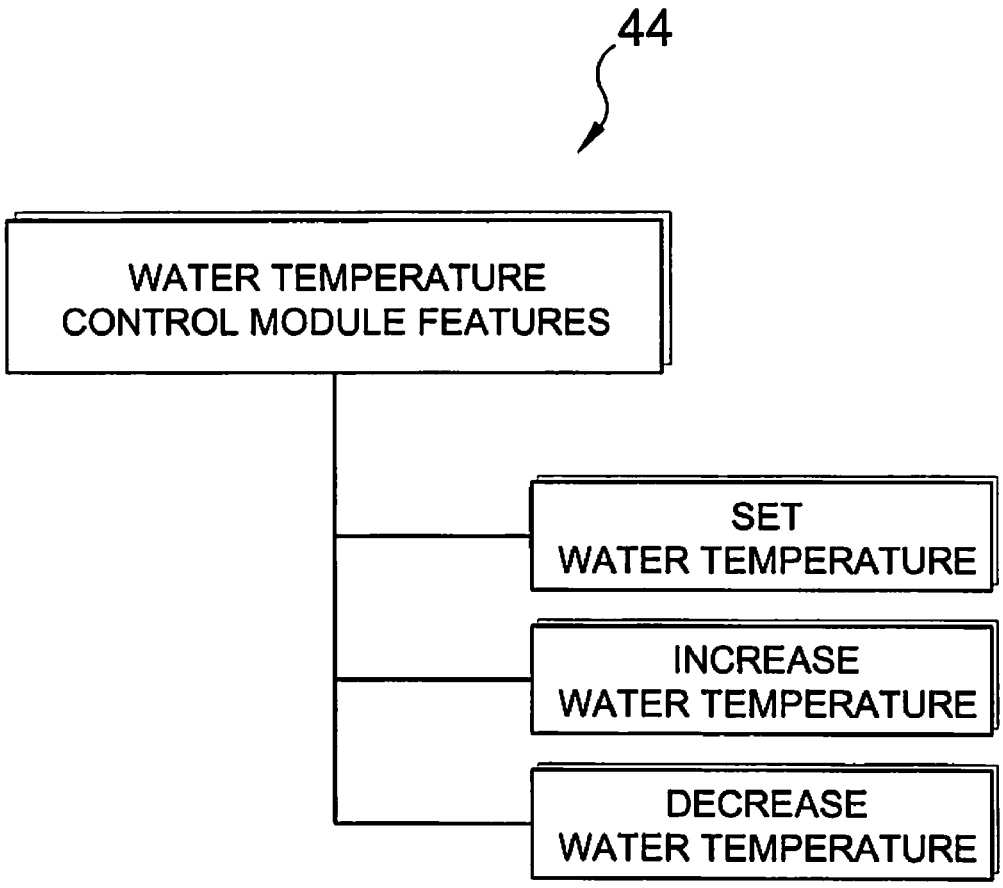
FIG. 9 is a block diagram of the present invention's water temperature control features.

FIG. 9 is a block diagram of the present invention's water temperature control module 44 features. The present invention is a tub having a water holding tank or jacket and a plurality of apertures in the tub so that water from the water jacket can be quickly transfer to the tub. Controls within the system provide means for the user to define and set water temperature. Additionally, the user may vary existing water temperature by selecting increase or decrease from preset temperature.

Figure 10:
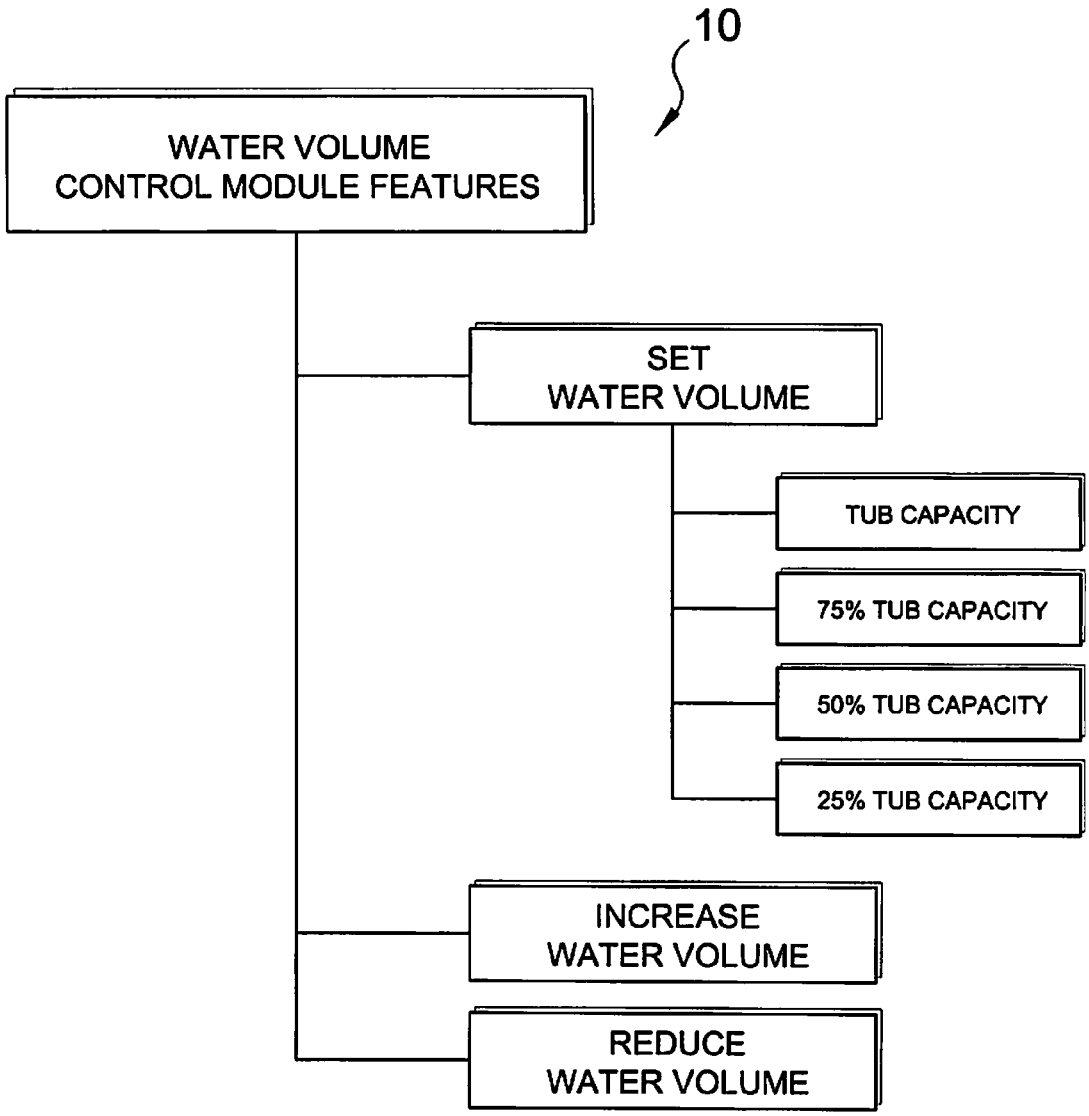
FIG. 10 is a block diagram of the present invention's water volume control features.

FIG. 10 is a block diagram of the present invention's water volume control module 46 features. The present invention is a tub having a water holding tank or jacket and a plurality of apertures in the tub so that water from the water jacket can be quickly transfer to the tub. Controls within the system provide means for the user to define and set water volume range of 25% to capacity with regard to the tubs volume. Additionally, the user may vary existing water volume by selecting increase or decrease from pre selected volume.

Figure 11:
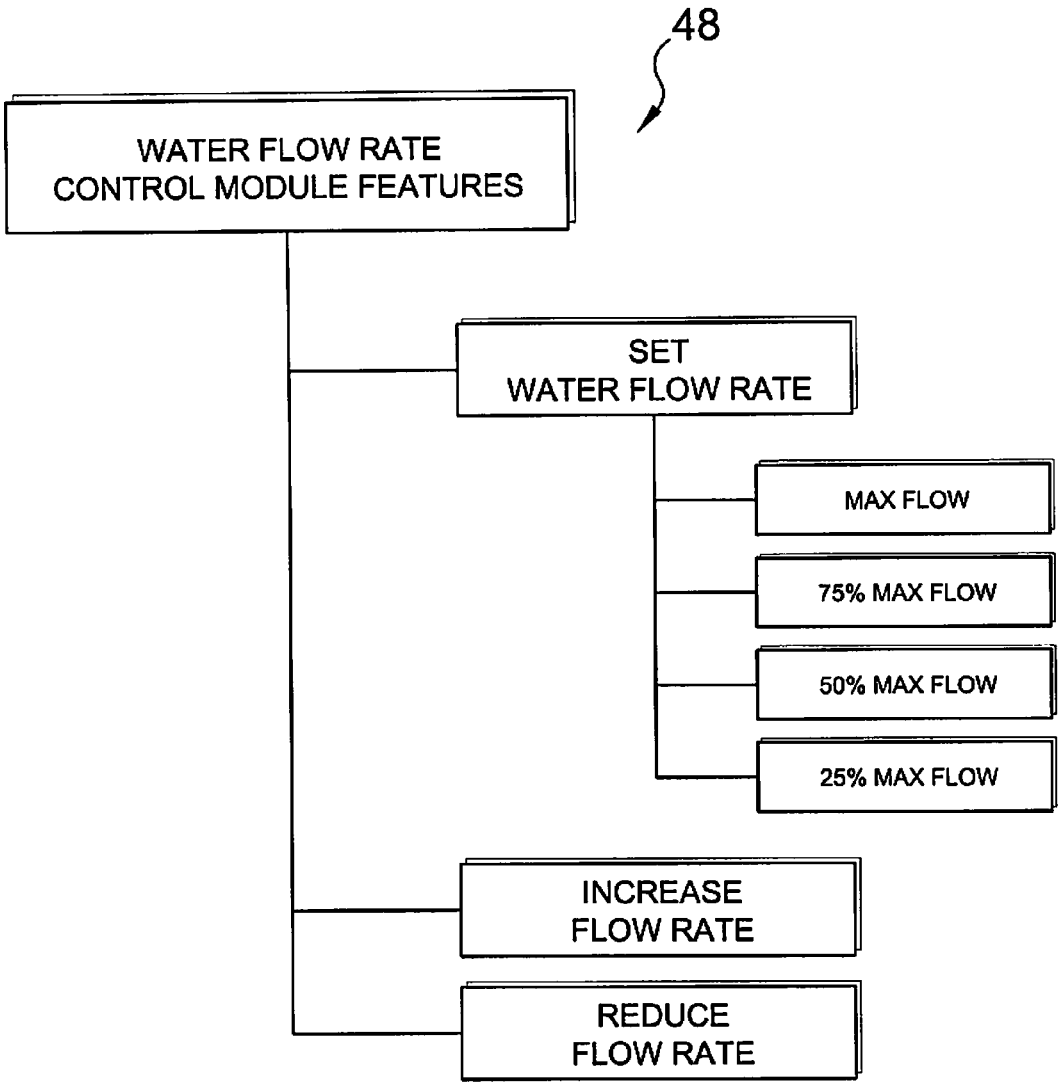
FIG. 11 is a block diagram of the present invention's water flow rate control features.

FIG. 11 is a block diagram of the present invention's water flow rate control module 48 features. The present invention is a tub having a water holding tank or jacket and a plurality of apertures in the tub so that water from the water jacket can be quickly transfer to the tub. Controls within the system provide means for the user to define and set flow rate of maximum to 25% maximum rate. Additionally, the user may vary existing water flow rate by selecting increase or decrease from pre selected flow rate.

Figure 12:
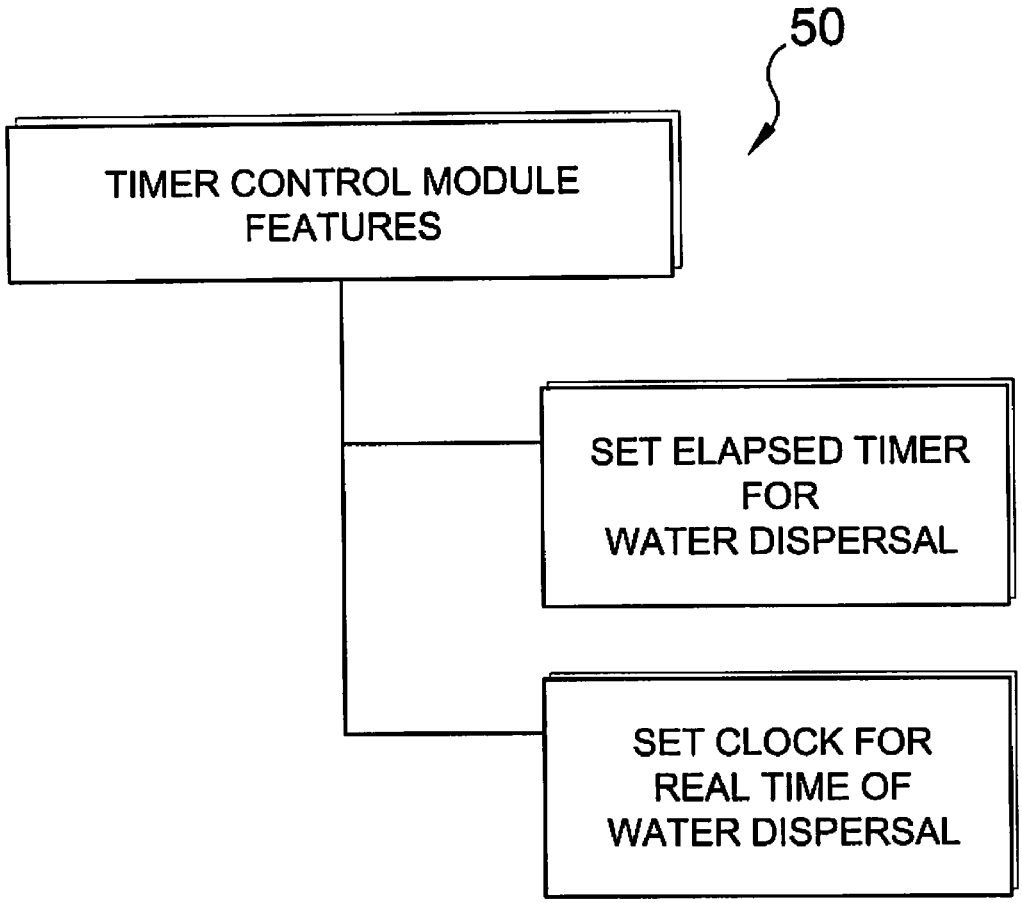
FIG. 12 is a block diagram of the present invention's timer control features.

FIG. 12 is a block diagram of the present invention's timer control module 50 features. The present invention is a tub having a water holding tank or jacket and a plurality of apertures in the tub so that water from the water jacket can be quickly transfer to the tub. Controls within the system provide means for the user to define and set the time for the water to be dispersed from the water jacket to the tub. The user may define an elapsed time from a set point in time, or may define the water to be dispersed at a given real time (example: 8:00 am).

Figure 13:
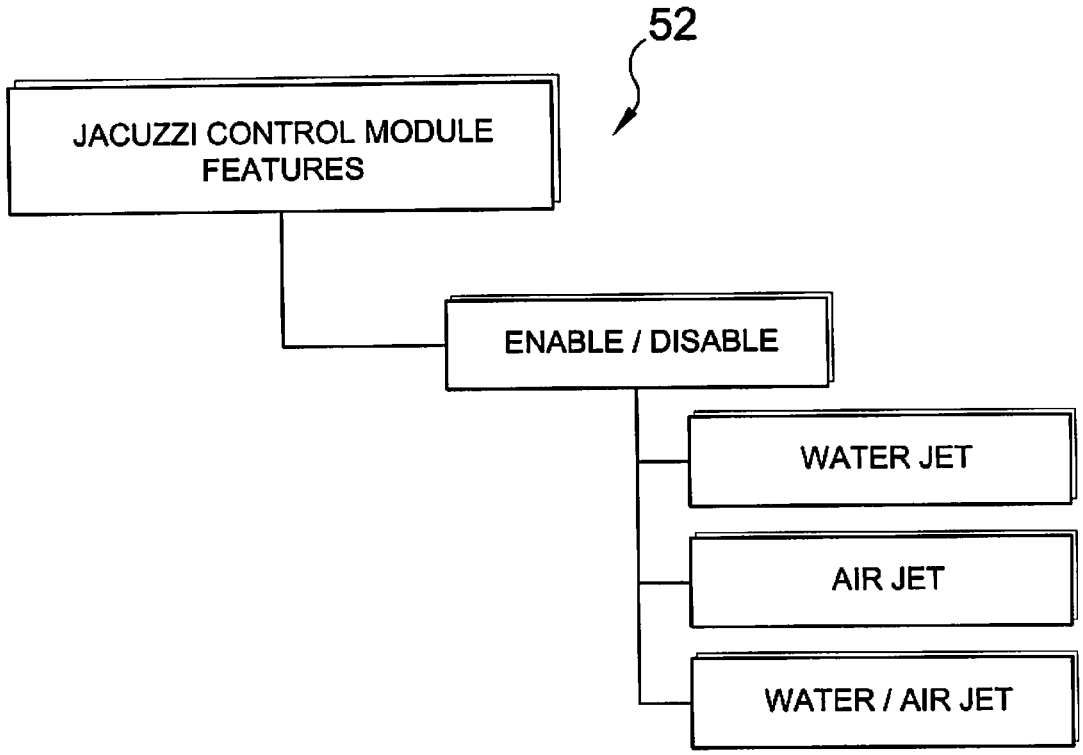
FIG. 13 is a block diagram of the present invention's jacuzzi control features.

FIG. 13 is a block diagram of the present invention's jacuzzi control module 52 features. The present invention is a tub having a water holding tank or jacket and a plurality of apertures in the tub so that water from the water jacket can be quickly transfer to the tub. Controls within the system provide means for the user to enable or disable jet propulsions of water, air, or a combination of water and air.

Figure 14:
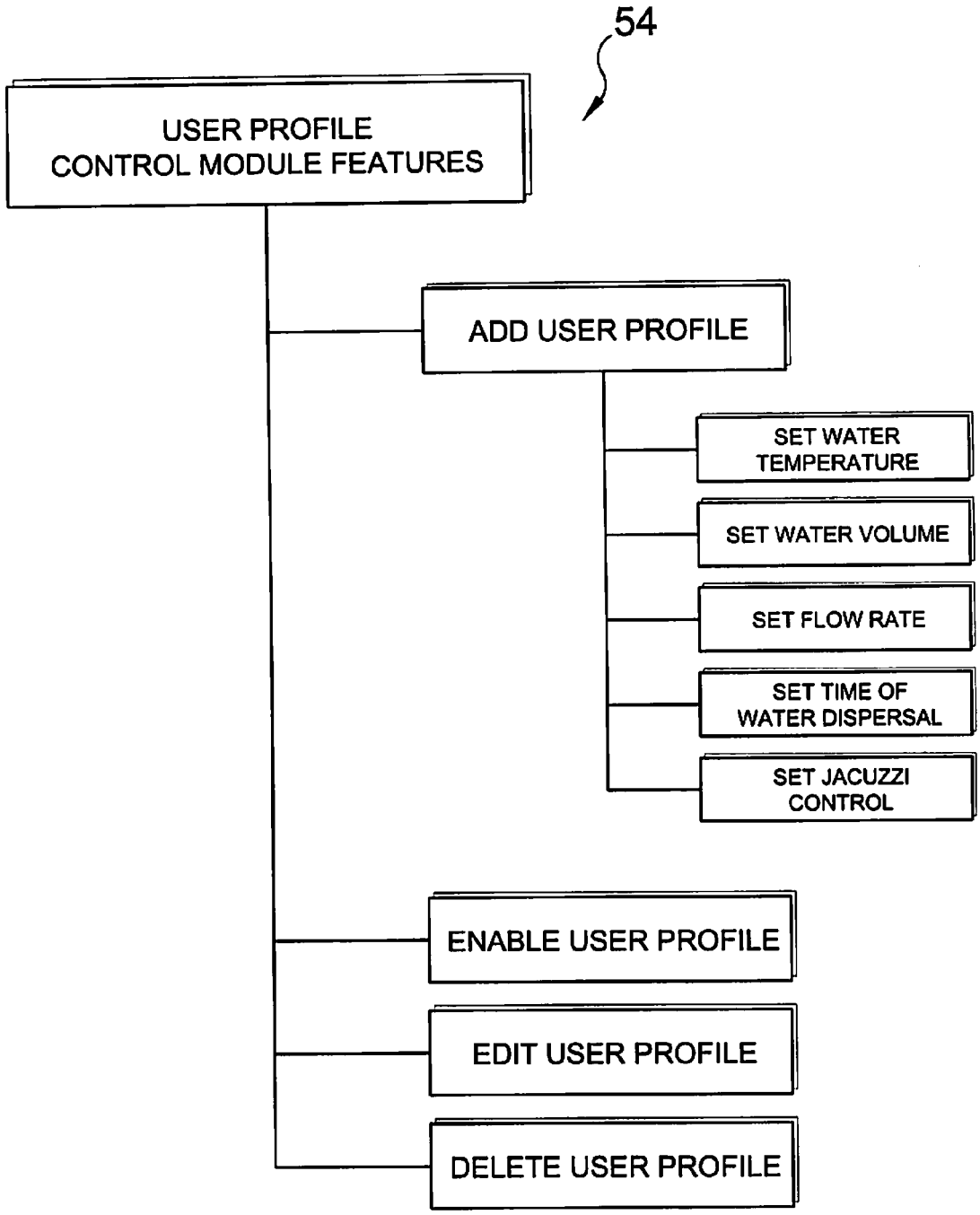
FIG. 14 is a block diagram of the present invention's user profile control features.

FIG. 14 is a block diagram of the present invention's user profile control module 54 features. The present invention is a tub having a water holding tank or jacket and a plurality of apertures in the tub so that water from the water jacket can be quickly transfer to the tub. Controls within the system provide means for the user to define a profile with pre defined settings. When a profile is enabled, the water is dispersed utilizing the user profile settings.

Figure 15:
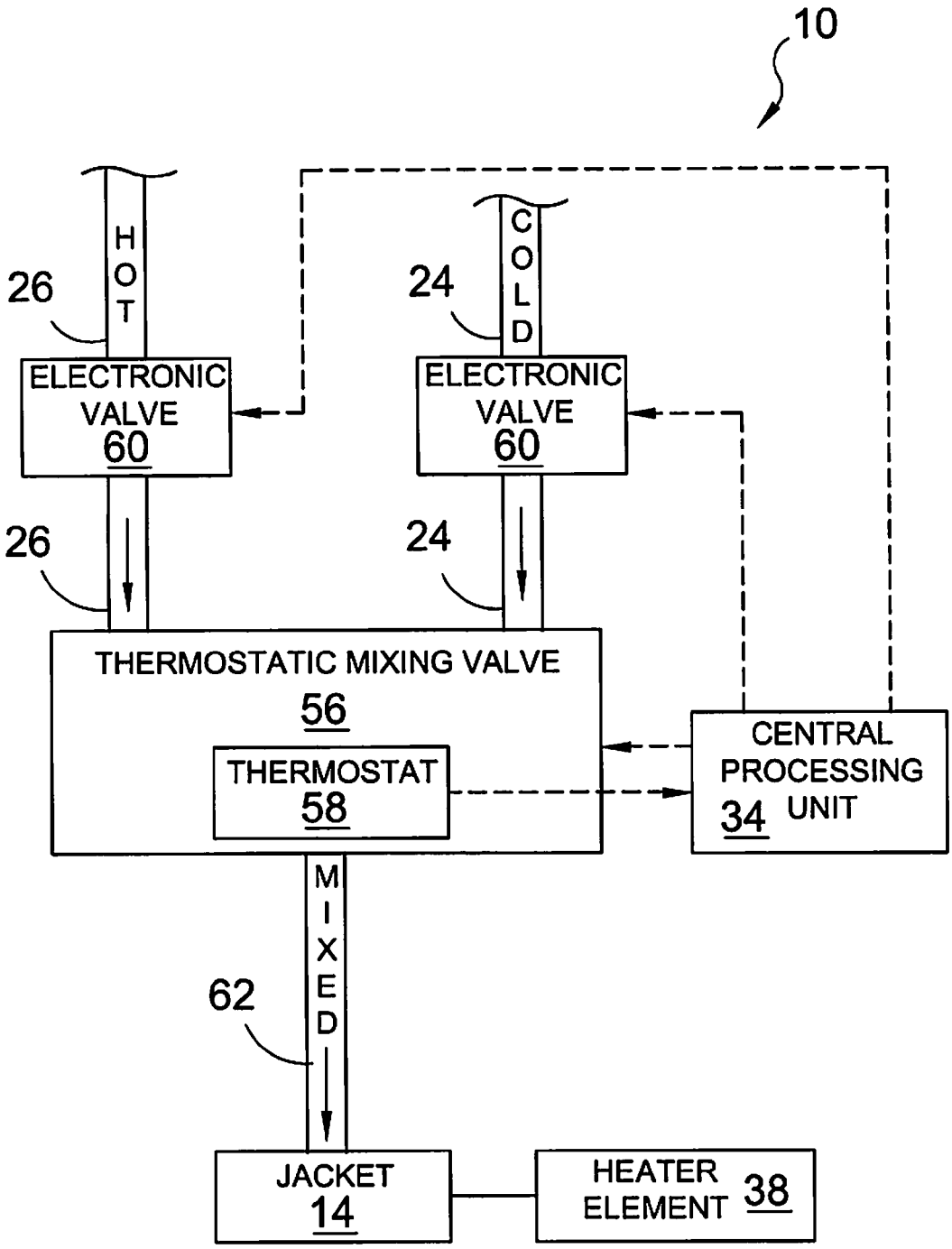
FIG. 15 is a block diagram of the water temperature control components of the present invention.

FIG. 15 is a block diagram of a preferred configuration of the water temperature control components of the present invention 10. Shown are the hot 26 and cold 24 feed lines with each having an electronic valve 60 disposed in-line therewith. The hot 26 and cold 24 feed lines terminate at a thermostatic mixing valve 56 having a thermostat 58 disposed proximal to a mixed water feed line 62 leading to the water jacket 14. The CPU 34 is in communication with the electronic valves 60, the thermostatic mixing valve 56 and the thermostat 58. The CPU 34 calls for water from the thermostatic mixing valve 56 at a predetermined amount of time prior to the user request for dispersal into the tub from the jacket 14 and the mixing valve 56 responds by opening to allow water from the hot 26 and cold 24 water feed lines pass therethrough into the mixed feed line 62 leading into the jacket 14. The thermostat 58 reads the temperature of the mixed water entering the mixed feed line 62 and delivers the data to the CPU 34. If the CPU 34 determines that the water mix is not within range of the user selected temperature, it sends a signal to the electronic valves 60 and makes the required adjustments so the water mix is adequate. The heater element 38 makes final thermal adjustments once the mixed water is in the jacket 14. This is an expedient and economical method of heating since it reduces the load on the heater element 38 because pre-temped water is introduced into the jacket 14.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention

What is claimed is new and desired to be protected by letters patent is set forth in the appended claims:

1. An apparatus for rapidly filling a basin with temperature conditioned water at a pre-appointed time in accordance with user input, said apparatus comprising:

a) a basin having a bottom and a surrounding wall;

b) a substantially hollow interior portion of said basin wall forming a reservoir extending entirely therearound for retaining fluid therein;

c) means for delivering water to said reservoir;

d) means for heating water in said reservoir to a pre-selected temperature and maintaining the temperature thereof;

e) a plurality of apertures disposed in said basin wall for transferring water from said reservoir to the basin;

f) timer means for determining when said temperature conditioned water is transferred from said reservoir to the basin;

g) flow control means for regulating the rate of entry of said water into said basin from said reservoir;

h) a user control unit to enable the user to adjust the various settings accordingly; and i) means for removing water from said basin.

2. The timed apparatus for the controlled filling of a basin with temperature controlled water as recited in claim 1, wherein said means for delivering water to said reservoir is a hot water feed and a cold water feed.

3. The timed apparatus for the controlled filling of a basin with temperature controlled water as recited in claim 2, wherein the water disposed within said reservoir is heated to a specific temperature and maintained thereat with a water heating element.

4. The timed apparatus for the controlled filling of a basin with temperature controlled water as recited in claim 3, wherein said control panel is in communication with a central processing unit that monitors, enables and disables the functions of the system according to user input.

5. The timed apparatus for the controlled filling of a basin with temperature controlled water as recited in claim 4, wherein said control panel includes user control buttons and a digital display.

6. The timed apparatus for the controlled filling of a basin with temperature controlled water as recited in claim 5, wherein said processor responds to user input of operational functions by communicating with the following components which respond accordingly:

a) water temperature control module;
b) water volume control module
c) water flow rate control module;
d) timer module;
e) spa jet control module; and
f) user settings module.

7. The timed apparatus for the controlled filling of a basin with temperature controlled water as recited in claim 6, wherein the functions of said water temperature control module include:

a) setting the water temperature;
b) increasing the water temperature; and
c) decreasing the water temperature.

8. The timed apparatus for the controlled filling of a basin with temperature controlled water as recited in claim 6, wherein said water volume control module enables the user to:

a) set the water volume at:
  i) tub capacity;
  ii) 75% of tub capacity;
  iii) 50% of tub capacity; and
  iv) 25% of tub capacity;
b) increase the water volume; and
c) decrease the water volume.

9. The timed apparatus for the controlled filling of a basin with temperature controlled water as recited in claim 6, wherein said water flow rate control module enables the user to:

a) set the water flow rate to:
  i) maximum flow
  ii) 75% max flow;
  iii) 50% max flow; and
  iv) 25% max flow;
b) increase the water flow; and
c) decrease the water flow.

10. The timed apparatus for the controlled filling of a basin with temperature controlled water as recited in claim 6, wherein said timer control features include:

a) setting the elapsed timer for water dispersal; and
b) setting the clock for real time of water dispersal.

11. The timed apparatus for the controlled filling of a basin with temperature controlled water as recited in claim 6, wherein said spa control module features include enabling and disabling:

a) a water jet;
b) an air jet; and
c) a water/air jet combo.

12. The timed apparatus for the controlled filling of a basin with temperature controlled water as recited in claim 6, wherein said user control profile provides for a plurality of user profiles preset to the preferences of each user by allowing each user to:

a) add a user profile:
  i) set water temperature;
  ii) set water volume;
  iii) set flow rate;
  iv) set time of water dispersal; and
  v) set spa control;
b) enable the user profile;
c) edit the user profile; and
d) delete the user profile.

13. The timed apparatus for the controlled filling of a basin with temperature controlled water as recited in claim 3, wherein said water is preheated to a temperature within a prespecified range of the preset temperature prior to introduction to said reservoir.

14. The timed apparatus for the controlled filling of a basin with temperature controlled water as recited in claim 13, further including a first electronic valve disposed in-line with said cold water feed and a second electronic valve disposed in-line with said hot water feed.

15. The timed apparatus for the controlled filling of a basin with temperature controlled water as recited in claim 14, wherein said hot water feed and said cold water feed terminate at a thermostatic mixing valve.

16. The timed apparatus for the controlled filling of a basin with temperature controlled water as recited in claim 15, wherein said mixing valve has a thermostat that monitors the temperature of the water mix passing therethrough and transmits that data to the central processing unit.

17. The timed apparatus for the controlled filling of a basin with temperature controlled water as recited in claim 16, wherein said central processing unit reads that the mixed water temperature is within the pre-determined range relative to the user selected temperature for dispersal and takes no action.

18. The timed apparatus for the controlled filling of a basin with temperature controlled water as recited in claim 16, wherein said central processing unit reads that the mixed water temperature is not within the pre-determined range relative to the user selected temperature for dispersal and delivers signals to said electronic valves and makes the necessary adjustments to provide the proper mix of hot and cold water.

19. The timed apparatus for the controlled filling of a basin with temperature controlled water as recited in claim 18, wherein said heater element makes minor adjustments for precise temperature control of the water in said jacket.

* * * * *